US007661669B2

(12) United States Patent
Ichihashi et al.

(10) Patent No.: US 7,661,669 B2
(45) Date of Patent: Feb. 16, 2010

(54) SHEET POST-PROCESSING APPARATUS, IMAGE FORMING APPARATUS, AND IMAGE FORMING SYSTEM

(75) Inventors: Ichiro Ichihashi, Aichi (JP); Masahiro Tamura, Kanagawa (JP); Nobuyoshi Suzuki, Tokyo (JP); Shuuya Nagasako, Kanagawa (JP); Naohiro Kikkawa, Kanagawa (JP); Kazuhiro Kobayashi, Kanagawa (JP); Tomohiro Furuhashi, Kanagawa (JP); Makoto Hidaka, Tokyo (JP); Hitoshi Hattori, Tokyo (JP); Junichi Tokita, Kanagawa (JP); Akira Kunieda, Tokyo (JP); Hiroshi Maeda, Aichi (JP); Tomoichi Nomura, Aichi (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 12/213,655

(22) Filed: Jun. 23, 2008

(65) Prior Publication Data

US 2009/0014939 A1 Jan. 15, 2009

(30) Foreign Application Priority Data

Jul. 10, 2007 (JP) ..... 2007-181368
Mar. 6, 2008 (JP) ..... 2008-057041

(51) Int. Cl.
*B65H 5/34* (2006.01)

(52) U.S. Cl. ..... 271/207; 270/58.09

(58) Field of Classification Search ..... 271/207, 271/221, 218; 270/58.09, 58.11, 58.12
See application file for complete search history.

(56) References Cited

U.S. PATENT DOCUMENTS

| | | | | |
|---|---|---|---|---|
| 2006/0261544 | A1 | 11/2006 | Tamura et al. | |
| 2007/0194521 | A1 * | 8/2007 | Matsumoto et al. | 271/270 |
| 2007/0235917 | A1 | 10/2007 | Nagasako et al. | |
| 2008/0006993 | A1 | 1/2008 | Nomura et al. | |
| 2008/0048380 | A1 | 2/2008 | Ichihashi et al. | |
| 2008/0067730 | A1 | 3/2008 | Suzuki et al. | |

FOREIGN PATENT DOCUMENTS

| | | |
|---|---|---|
| JP | 08-073108 | 3/1996 |
| JP | 11-139673 | 5/1999 |
| JP | 2000-272809 | 10/2000 |

* cited by examiner

*Primary Examiner*—Kaitlin S Joerger
(74) *Attorney, Agent, or Firm*—Harness, Dickey & Pierce

(57) ABSTRACT

A sheet post-processing apparatus includes a sheet stacking unit, an aligning unit, a moving member, a discharging member, and a discharging motor. The discharging motor drives the discharging member for discharging a pile of sheets in an operation pattern that is selected, depending on a predetermined condition, from among a plurality of operation patterns.

11 Claims, 7 Drawing Sheets

SHEET POST-PROCESSING APPARATUS, IMAGE FORMING APPARATUS, AND IMAGE FORMING SYSTEM

CROSS-REFERENCE TO RELATED APPLICATIONS

The present application claims priority to and incorporates by reference the entire contents of Japanese priority documents 2007-181368 filed in Japan on Jul. 10, 2007 and 2008-057041 filed in Japan on Mar. 6, 2008.

BACKGROUND OF THE INVENTION

1. Field of the Invention

The present invention relates to a sheet post-processing apparatus, an image forming apparatus, and an image forming system including the sheet post-processing apparatus and the image forming apparatus.

2. Description of the Related Art

A sheet post-processing apparatus is widely used for performing post-processing, such as sorting, stapling, or stacking of sheets (printing sheets) received from an image forming apparatus, such as a copy machine or a printer. The sheet post-processing apparatus is, for example, a sorter or a finisher. The sheet post-processing apparatus is arranged downstream of the image forming apparatus.

For example, in Japanese Patent Application Laid-open No. H11-139673, a technology of such a sheet post-processing apparatus are disclosed in which a plurality of sheets conveyed to a staple tray in the sheet post-processing apparatus is aligned in a conveying direction by putting an edge of each of the sheets in contact with a rear-end fence arranged on a lower portion of the staple tray, and a discharging claw then directly scoops up the pile by supporting an edge of a pile of the sheets, thereby discharging the pile out of the staple tray.

In the conventional technology disclosed in Japanese Patent Application Laid-open No. H11-139673, a linear speed of the discharging claw when the discharging claw is moved into contact with the rear edge of the pile of the sheets is made different from a linear speed of the discharging claw when the rear edge of the pile is moved apart from the discharging claw, thereby preventing the sheets from being damaged by the discharging claw when the pile is discharged.

In the conventional technology, every time when the pile of the sheets is discharged from the staple tray, the discharging operation is controlled in the same control pattern. However, a load applied to the discharging claw during operation of discharging the pile depends on various conditions, such as a size and a type of the sheet, and the number of stapled sheets in the pile.

Therefore, if the discharging operation is always controlled in the same control pattern, it is difficult to improve a productivity of a high-speed machine in which a high accuracy and a high productivity are required.

SUMMARY OF THE INVENTION

It is an object of the present invention to at least partially solve the problems in the conventional technology.

According to an aspect of the present invention, there is provided a sheet post-processing apparatus that includes a sheet stacking unit that receives a plurality of sheets from an upstream apparatus and stacks the sheets in a pile thereon; an aligning unit that aligns the sheets stacked on the sheet stacking unit in a direction orthogonal to a conveying direction of the sheets; a moving member that moves up the pile of the sheets aligned by the aligning unit; a discharging member that receives the pile from the moving member and scoops up the pile by supporting a bottom edge of the pile for discharging the pile out of the sheet stacking unit; and a discharging motor that drives the discharging member in an operation pattern that is selected, depending on a predetermined condition, from among a plurality of operation patterns in which the discharging motor can drive.

According to another aspect of the present invention, there is provided an image forming apparatus that transfers an image onto a recording medium and discharges the recording medium after fixing the image thereon to a sheet post-processing apparatus, wherein the above sheet post-processing apparatus is attached to the image forming apparatus.

According to still another aspect of the present invention, there is provided an image forming system that includes the above sheet post-processing apparatus; and the above image forming apparatus.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

Figure 1:
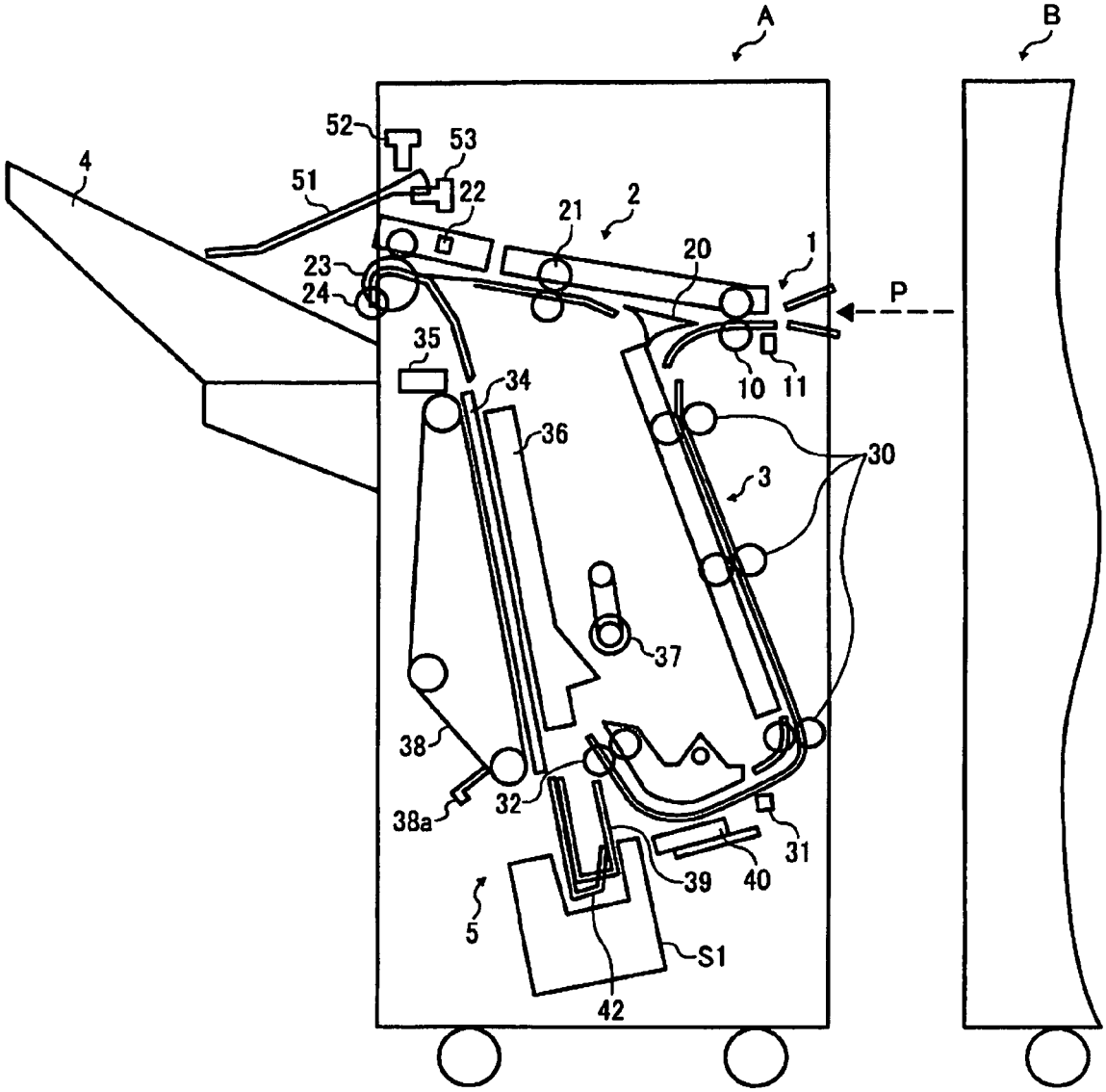
FIG. 1 is a schematic diagram of a sheet post-processing apparatus according to an embodiment of the present invention.

FIG. 1 is a schematic diagram of a sheet post-processing apparatus A according to an embodiment of the present invention. The sheet post-processing apparatus A is attached to an image forming apparatus B. The image forming apparatus B transfers a formed image onto a received sheet P (recording medium) and discharges the sheet P to a downstream apparatus after the image is fixed on the sheet P.

The sheet processing device A includes a guide path 1, an upper conveying path 2, and a lower conveying path 3. The guide path 1 receives a sheet P that is discharged out of an image forming apparatus B. The upper conveying path 2 and the lower conveying path 3 are branched from the guide path 1. The upper conveying path 2 extends toward a catch tray 4. The lower conveying path 3 is arranged for a stapling process.

The sheet post-processing apparatus A is arranged downstream of the image forming apparatus B that is an upstream apparatus that discharges a processed sheet P to the sheet post-processing apparatus A. The sheet post-processing apparatus A and the image forming apparatus B configure an image forming (processing) system. When the image forming apparatus B starts performing an image forming operation, the catch tray 4 is moved to a predetermined level. When it is determined that the catch tray 4 is positioned at the level such that the catch tray 4 is full of the stacked sheets P, a control unit (not shown) stops the image forming system from performing the image forming operation.

A guide roller 10 and an entrance sensor 11 are arranged on the guide path 1. A separation claw 20 is arranged at an end of the guide path 1, i.e., arranged at a point where the upper conveying path 2 and the lower conveying path 3 are branched from the guide path 1. The separation claw 20 rotates to switch a conveying direction of the sheet P between the upper conveying path 2 and the lower conveying path 3.

A conveying roller 21, a discharge sensor 22, a discharging roller 23, and a shifting roller 24 are arranged on the upper conveying path 2. The sheet P that is not conveyed to the lower conveying path 3 is delivered along the upper conveying path 2, and discharged to the catch tray 4. The discharged sheet P is sequentially stacked on the catch tray 4.

A rotatable filler 51 is arranged above a discharge opening of the sheet post-processing apparatus A. An end of the filler 51 is located at and in contact with a point near the center of the uppermost sheet P stacked on the catch tray 4.

A first upper-surface detecting sensor 52 and a second upper-surface detecting sensor 53 are arranged near a base portion of the filler 51. The first upper-surface detecting sensor 52 and the second upper-surface detecting sensor 53 detect a level of the end of the filler 51, thereby detecting a level of the upper surface of the uppermost sheet P stacked on the catch tray 4.

The first upper-surface detecting sensor 52 and the second upper-surface detecting sensor 53 are arranged in such a manner that the base portion of the filler 51 is vertically sandwiched therebetween. The base portion of the filler 51 is positioned in the middle between the first upper-surface detecting sensor 52 and the second upper-surface detecting sensor 53, i.e., both the first upper-surface detecting sensor 52 and the second upper-surface detecting sensor 53 are OFF. A position near the second upper-surface detecting sensor 53, i.e., a position at which the second upper-surface detecting sensor 53 is switched from ON to OFF is set to a home position of the base portion of the filler 51.

When the number of the sheets P stacked on the catch tray 4 increases, i.e., the level of the upper surface of the uppermost sheet P becomes higher, the second upper-surface detecting sensor 53 is turned ON. The control unit then controls a driving unit (not shown) to move down the catch tray 4. The driving unit is configured to move the catch tray 4 up and down.

When the catch tray 4 moves down, and the second upper-surface detecting sensor 53 is turned OFF, the control unit stops the catch tray 4 from moving down. This operation is repeatedly performed. When the catch tray 4 reaches a predetermined level at which the catch tray 4 is full of the stacked sheets P, the sheet post-processing apparatus A feeds a stop signal to the image forming apparatus B, thereby stopping the image forming system from performing the image forming operation.

Lower conveying rollers 30, an ejection sensor 31, and an ejecting roller 32 are arranged on the lower conveying path 3. A stapling unit 5 is arranged at the end of the lower conveying path 3, and includes a stapler S1 and a staple tray 34. The stapler S1 for stapling an end portion of a pile of the sheets P moves forward and backward in a direction orthogonal to the surface of the sheet P. The staple tray 34 stacks thereon the sheets P to be discharged.

The stapling unit 5 further includes a jogger fence unit 36 including jogger fences 36*a* and 36*b* (see, FIG. 2), a tapping roller 37, a discharging belt 38, a discharging claw 38*a*, a rear-end fence unit 39 including rear-end fences 39*a* and 39*b* (see, FIG. 2), and a rear-end presser 40. The jogger fence unit 36 moves forward and backward in a direction orthogonal to the surface of the sheet P to align the sheets P stacked on the staple tray 34. The rear-end presser 40 moves forward and backward in the thickness direction of the sheet P.

As described above, the stapling unit 5 includes the staple tray 34, the discharging belt 38, the discharging claw 38*a*, and a discharging motor 35. The discharging motor 35 drives the discharging belt 38 and the discharging claw 38*a*. Thus, the stapling unit 5 functions also as a discharging unit. A movable fence unit 42 shown in FIG. 1 includes movable fences 42*a* and 42*b* (see, FIG. 2).

When the sheet post-processing apparatus A receives a staple mode signal for stapling an end portion of the pile from the image forming apparatus B, the stapler S1 moves in the direction orthogonal to the surface of the sheet P to an appropriate position of the lower portion of the pile and then stands by at that position. When the sheet P is conveyed along the lower conveying path 3, the sheet P is ejected to the staple tray 34 by the ejecting roller 32, and is tapped at the upper surface thereof by the tapping roller 37, so that the sheets P are aligned in the longitudinal direction.

The sheets P are aligned in the width direction by the jogger fence unit 36. When the sheet P is put into the rear-end fence unit 39, the rear-end presser 40 presses the rear end of the sheet P against the staple tray 34, so that a subsequent sheet can be easily put into the rear-end fence unit 39.

After the predetermined number of sheets P is stacked and aligned on the staple tray 34, the stapler S1 moves from the standby position to a stapling position, and staples the sheets P at the stapling position. The pile of the stapled sheets P is delivered along the discharging belt 38 in a counterclockwise direction while the lower edge of the pile is supported by the discharging claw 38*a*. In this manner, the pile is moved upward, and then discharged to the catch tray 4.

In a stapling mode, the home position of the discharging claw 38*a* is defined such that the base portion of the filler 51 is located near the first upper-surface detecting sensor 52, i.e., the first upper-surface detecting sensor 52 is switched from OFF to ON. Thus, the first upper-surface detecting sensor 52 functions as a discharging-claw home sensor that detects the home position of the discharging claw 38*a*.

As described above, when the number of the sheets P stacked on the catch tray 4 increases, i.e., the level of the upper surface of the uppermost sheet P becomes higher, the first upper-surface detecting sensor 52 as a discharging-claw home sensor is turned OFF. The control unit then controls the driving unit to move down the catch tray 4.

When the catch tray 4 moves down, and the first upper-surface detecting sensor 52 is turned ON, the control unit stops the catch tray 4 from moving down. This operation is repeatedly performed. When the catch tray 4 reaches a predetermined level at which the catch tray 4 is full of the stacked sheets P, the sheet post-processing apparatus A feeds a stop signal to the image forming apparatus B, thereby stopping the image forming system from performing the image forming operation.

Figure 2:
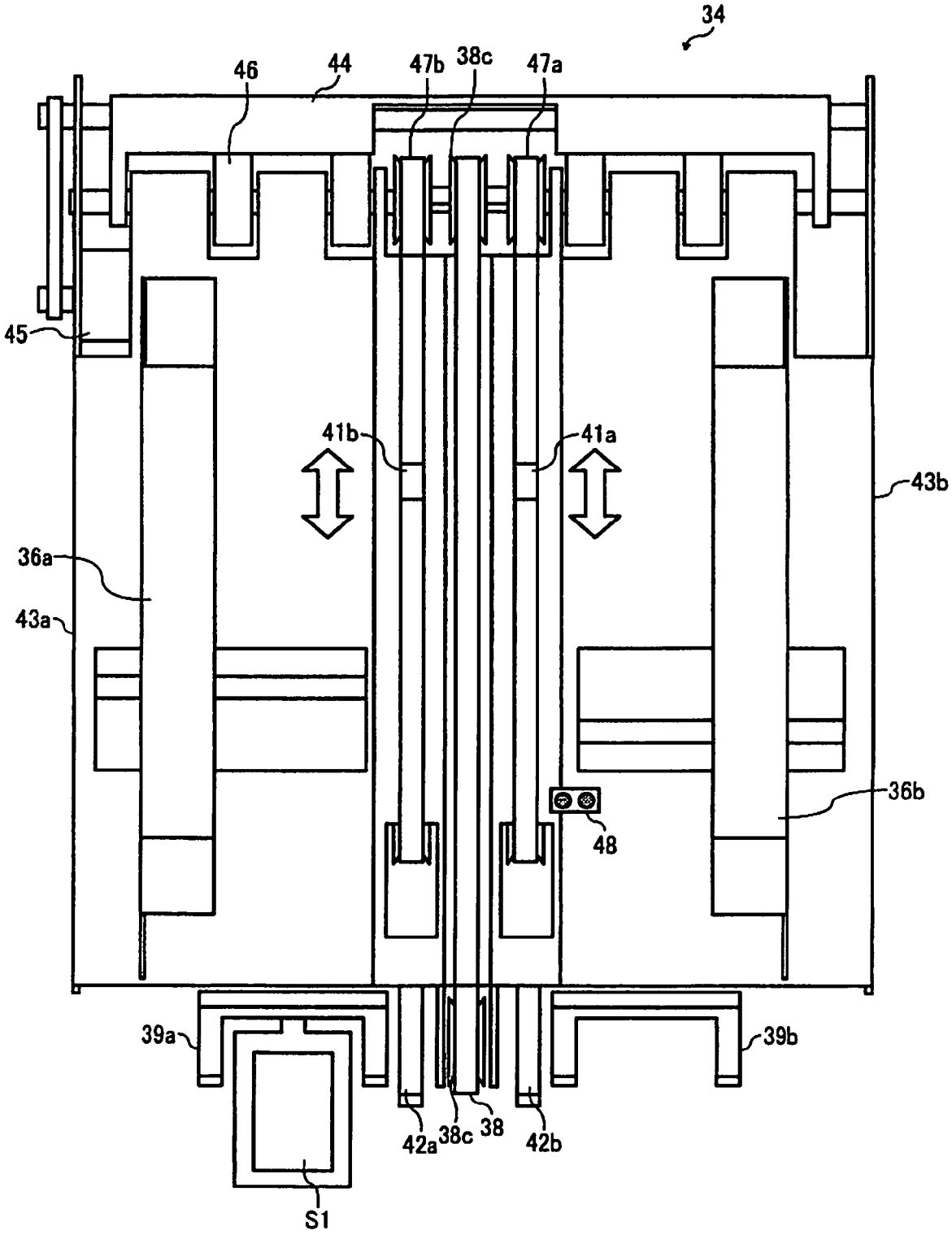
FIG. 2 is a schematic diagram of a staple tray of the sheet post-processing apparatus seen in a direction perpendicular to a surface of the staple tray on which a sheet is conveyed.

FIG. 2 is a schematic diagram of the staple tray 34 seen in the direction perpendicular to the surface of the staple tray 34 on which the sheet P is conveyed.

When the sheet post-processing apparatus A receives the sheets P from the image forming apparatus B that is an upstream apparatus, the sheets P are aligned in the width direction by the jogger fences 36*a* and 36*b* and in the longitudinal direction by an end stopper unit 41 that includes end stoppers 41*a* and 41*b* putting the sheets P in contact with the rear-end fences 39*a* and 39*b*.

After the alignment of the sheets P is completed, the stapler S1 staples the sheets P. The pile of the stapled sheets S1 is moved up by the movable fences 42*a* and 42*b*. Each of the movable fences 42*a* and 42*b* and the rear-end fences 39*a* and 39*b* includes a receiving member (not shown) that receives the sheet P. The receiving members of the movable fences 42*a* and 42*b* are located in a slightly lower position than the receiving members of the rear-end fences 39*a* and 39*b*. With this configuration, the receiving members of the movable fences 42*a* and 42*b* do not interfere with the sheets P when the end stoppers 41*a* and 41*b* align the sheets P in the longitudinal direction by putting the sheets P in contact with the rear-end fences 39*a* and 39*b*.

As described above, because the rear-end fences 39*a* and 39*b* are arranged in a position lower than the lower portion of the staple tray 34, it is possible to prevent misalignment of the sheets P. The movable fences 42*a* and 42*b* are arranged as a mechanism of moving up the pile of the sheets P to an operating range of the discharging claw 38*a* in which the discharging claw 38*a* can receive the sheets P from the movable fence unit 42 and scoop up the received sheets P.

After the pile of the sheets P is moved up by the movable fences 42*a* and 42*b*, the discharging belt 38 rotates in the counterclockwise direction in FIG. 1, and the discharging claw 38*a* attached to the discharging belt 38 receives the pile of sheets P from the movable fences 42*a* and 42*b*. The discharging claw 38*a* then discharges the pile out of the staple tray 34.

It should be noted that the above-described operation can be performed on unstapled sheets on which the stapling process is not performed after the alignment process is finished. As shown in FIG. 2, the staple tray 34 further includes a pulley 38*c* that rotates the discharging belt 38, a front side plate 43*a*, a back side plate 43*b*, a movable guide 44, a pile-separation drive motor 45, a discharging roller 46, conveying belts 47*a* and 47*b*, and a sheet presence sensor 48.

Figure 3:
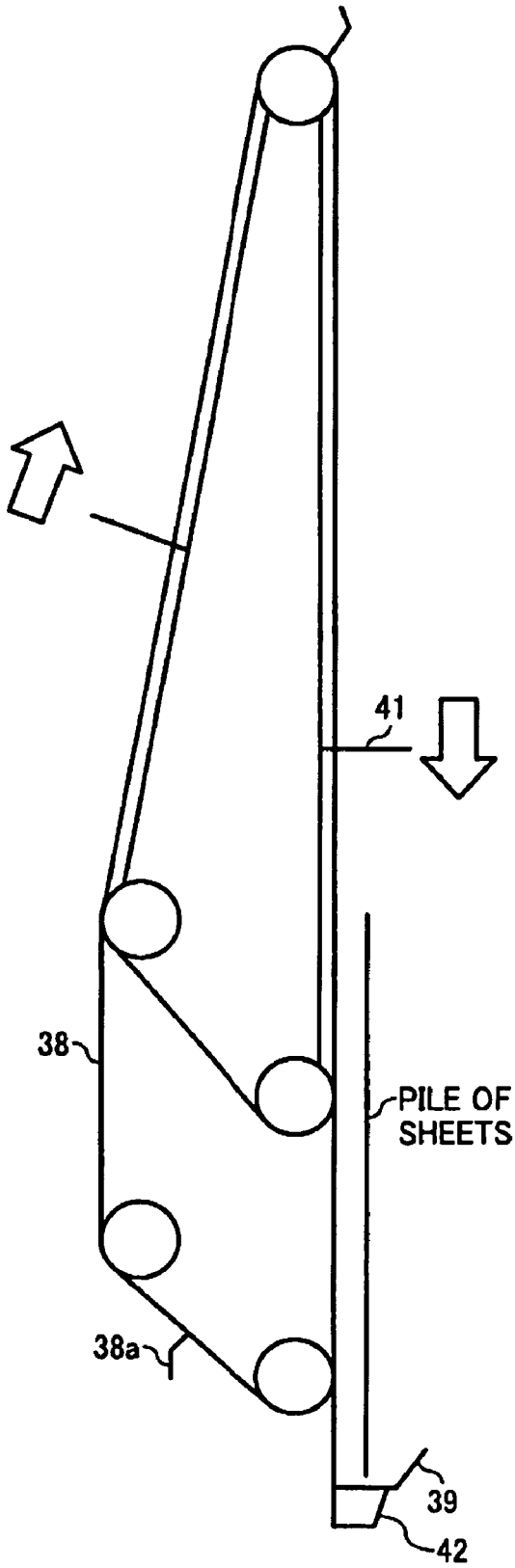
FIG. 3 is a schematic diagram for explaining a positional relation between an end stopper unit, a discharging claw, a rear-end fence unit, and a movable fence unit of the sheet post-processing apparatus.

FIG. 3 is a schematic diagrams for explaining a positional relation between the end stopper unit 41, the discharging claw 38*a* attached to the discharging belt 38, the rear-end fence unit 39, and the movable fence unit 42.

The number of the sheets P that have been conveyed to and aligned on the staple tray 34 is counted by the CPU 71 of the sheet post-processing apparatus A, or is obtained based on data received from the image forming apparatus B.

Figure 4:
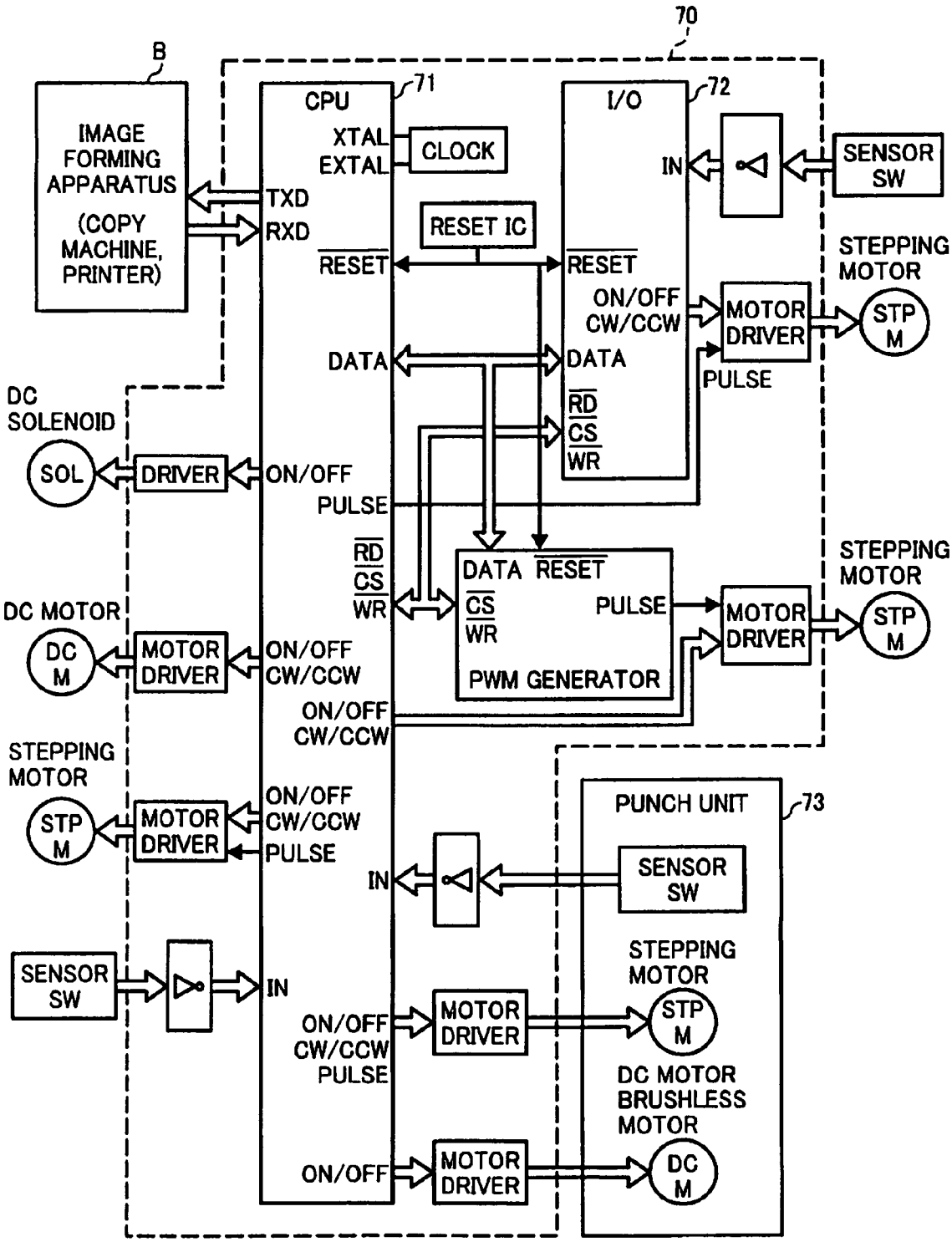
FIG. 4 is a block diagram of a control circuit of the sheet post-processing apparatus.

FIG. 4 is a block diagram of a control circuit 70 of the sheet post-processing apparatus A according to the embodiment.

The control circuit 70 is also a control circuit of the image forming apparatus B, and includes a microcomputer having a central processing unit (CPU) 71, an input/output (I/O) interface 72, or the like. A detailed description on the control of respective members of the image forming apparatus B is omitted.

A signal is fed from a punch unit 73, a switch of a control panel (not shown) included in a main body of the image forming apparatus B, and a sensor such as a sheet-surface detecting sensor, to the CPU 71 via the I/O interface 72.

The CPU 71 controls based on an input signal a motor (not shown) for shifting a shift tray (not shown), a motor (not shown) for opening and closing a discharge guide plate (not shown), a motor for moving the shift tray, a motor (not shown) for driving the tapping roller 37 (FIG. 1), a solenoid (SOL) such as a tapping SOL (not shown), a motor (not shown) for driving the conveying roller, and a motor (not shown) for driving the discharging roller.

The CPU 71 also controls motors, such as a motor (not shown) for driving the discharging belt 38 and the discharging claw 38*a* (FIG. 1), a motor (not shown) for moving the stapler S1 (FIG. 2), a motor (not shown) for rotating the stapler S1 in an oblique direction, a motor (not shown) for moving the jogger fences 36*a* and 36*b* (FIG. 2), the pile-separation drive motor 45 (FIG. 2) for rotating the movable guide 44, and a motor (not shown) for driving the conveying roller that conveys the pile.

Furthermore, the CPU 71 controls a motor (not shown) for moving the movable fences 42*a* and 42*b* (FIG. 2), a motor (not shown) for moving a folding plate (not shown), a motor (not shown) for driving a folding roller (not shown), and the like.

A pulse signal for driving a stapled-sheet conveying motor (not shown) that drives a stapled-sheet discharging roller (not shown) is input to the CPU 71, and the input pulse signal is counted by the CPU 71. The tapping SOL and the motor for moving the jogger fences 36*a* and 36*b* are controlled based on the counted pulse signal.

Figure 5:
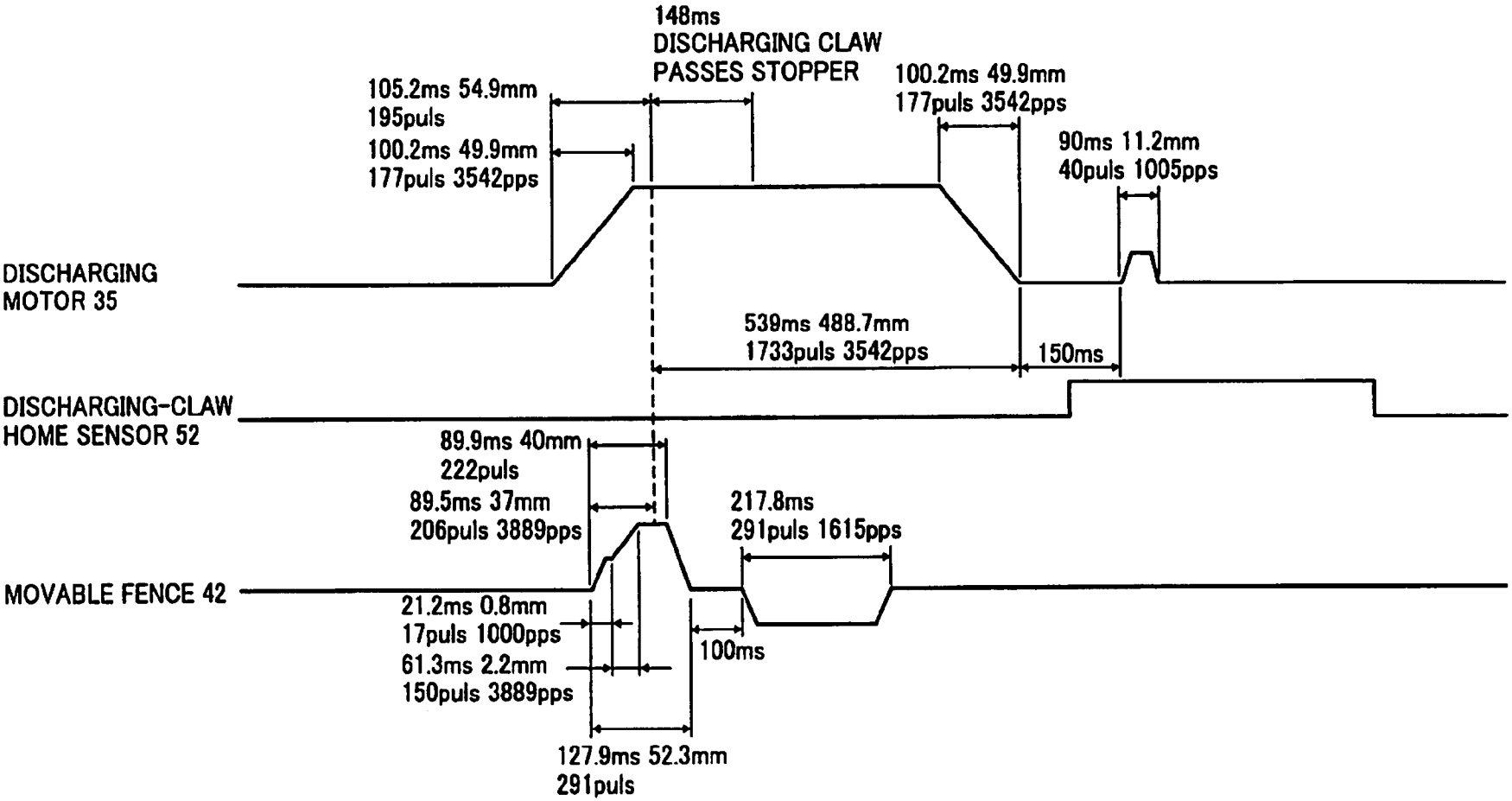
FIG. 5 is a timing chart for explaining a first pattern for discharging a pile of sheets.
Figure 6:
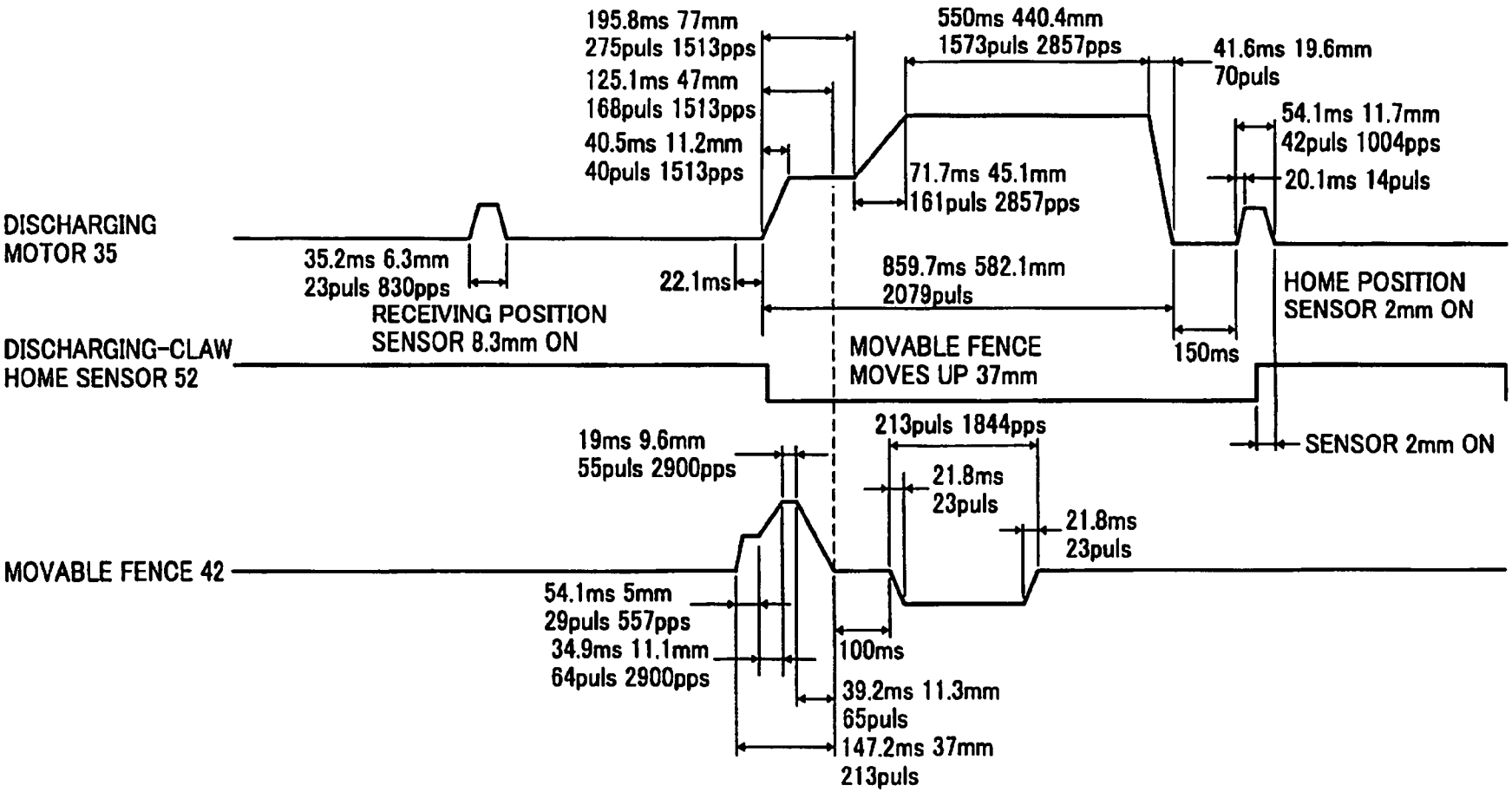
FIG. 6 is a timing chart for explaining a second pattern for discharging a pile of sheets.

FIG. 5 is a timing chart for explaining a first pattern for discharging the pile of the sheets P. FIG. 6 is a timing chart for explaining a second pattern for discharging the pile of the sheets P.

In the first pattern, after a driving linear speed of the discharging motor 35 is increased to a predetermined level for discharging the pile, the discharging claw 38*a* receives the pile from the movable fence unit 42, and then discharges the received pile.

The discharging claw 38*a* discharges the pile in the first pattern when the number of the sheets P contained in the pile is small, i.e., a low load can be applied to the discharging claw 38*a* when the discharging claw 38*a* scoops up the pile. In this manner, a time required for discharging the sheets P can be shortened, and the productivity can be improved.

In the second pattern, when the discharging claw 38*a* receives the pile from the movable fence unit 42, the discharging motor 35 operates at a low speed. After the discharging claw 38*a* receives the pile from the movable fence 42, a driving linear speed of the discharging motor 35 is increased to a predetermined driving linear speed for discharging the pile. The discharging claw 38*a* then discharges the pile.

The number of the sheets P that have been conveyed to and aligned on the staple tray 34 (FIG. 2) is counted by the CPU (FIG. 4), or is obtained based on data received from the image forming apparatus B.

When it is determined that the number of the sheets P is equal to or more than the predetermined number, i.e., the high load can be applied to the discharging claw 38*a*, the linear speed of the motor decreases to a low level to obtain a higher torque. The discharging claw 38*a* receives the pile from the movable fence unit 42 with the motor at the low linear-speed level. After that, the linear speed of the motor increases to a level for discharging the pile.

When it is determined that the number of the sheets P is less than the predetermined number, the discharging claw 38*a* receives the pile from the movable fence unit 42 at the linear speed that is the same as that for discharging the pile, and discharges the received pile, in the same manner as described in the first patter.

The driving linear speed of the motor for discharging the pile is determined and changed depending on the size of the sheet P and the number of the stapled sheets P. Specifically, it is determined whether the sheet P is small-sized or large-sized. Then, a linear speed v1 for discharging the small-sized sheet P and a linear speed v2 for discharging the large-sized sheet P are determined in such a manner that the relation v1>v2 is satisfied.

If the sheet P is large-sized, it is determined whether the number of the large-sized sheets P is equal to or more than the predetermined number, or less than the predetermined number. Then, a linear speed v2 for discharging the sheets P larger than the predetermined number and a linear speed v3 for discharging the sheets P smaller than the predetermined number are determined in such a manner that the relation v2<v3 is satisfied.

As described above, when the number of sheets P is large, i.e., the high load can be applied to the discharging claw 38*a*, a torque of the discharging motor is increased when the discharging claw 38*a* receives the pile from the movable fence unit 42. Therefore, it is possible to prevent step-out of the discharging motor. Thus, the reliability can be improved.

Figure 7:
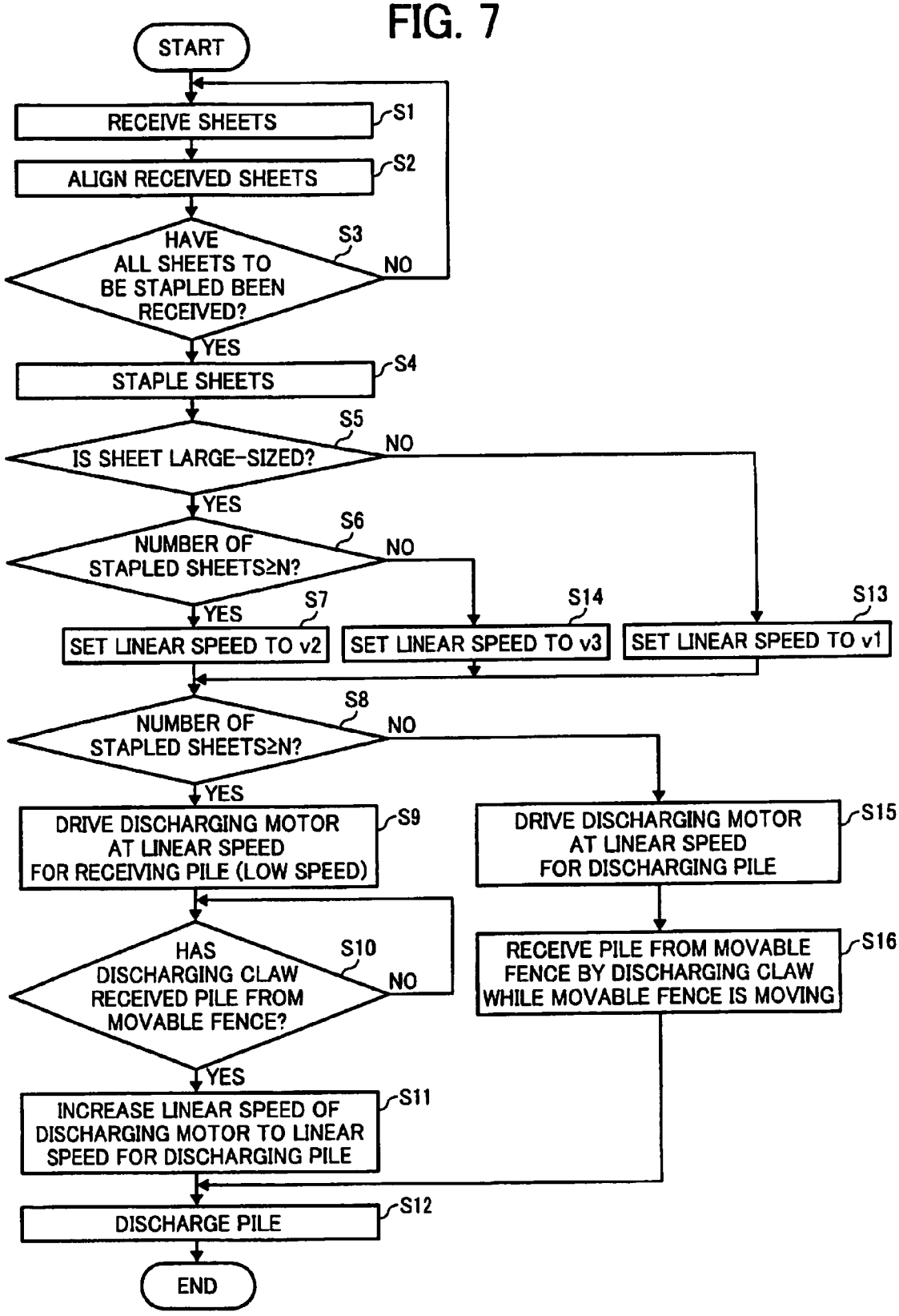
FIG. 7 is a flowchart of an operation performed by an image forming system for discharging the pile of the sheets according to the embodiment of the present invention.

FIG. 7 is a flowchart of an operation performed by the image forming system for discharging the pile of the sheets P.

The sheet post-processing apparatus A receives the sheets P having images formed thereon from the image forming apparatus B (Step S1). Then, the received sheets P are aligned in the width direction and the longitudinal direction by the jogger fence unit 36, the end stoppers 41*a*, 41*b*, and the rear-end fence unit 39 (Step S2).

Subsequently, it is determined whether all the sheets P to be stapled have been received (Step S3). If all the sheets P to be stapled have been received (Yes at Step S3), the sheets P are stapled by the stapler S1 (Step S4). Then, it is determined whether the sheets P are large-sized (Step S5).

If the sheets P are large-sized (Yes at Step S5), it is determined whether the number of the stapled sheets P is equal to or more than N (Step S6). If the number of the stapled sheets P is equal to or more than N (Yes at Step S6), a linear speed of the discharging motor 35 for discharging the pile is set to a linear speed v2 (Step S7). Then, it is determined whether the number of the stapled sheets P is equal to or more than N (Step S8).

If the number of the stapled sheets P is equal to or more than N (Yes at Step S8), the discharging motor 35 operates at a linear speed for receiving the pile (at a low speed) (Step S9). Then, it is determined whether the discharging claw 38*a* has received the pile from the movable fence unit 42 (Step S10). If the discharging claw 38*a* has received the pile from the movable fence unit 42 (Yes at Step S10), a linear speed of the discharging motor 35 is increased to a linear speed for discharging the pile (Step S11). The discharging claw 38*a* then discharges the pile (Step S12).

If the sheets P are not large-sized (No at Step S5), a linear speed of the discharging motor 35 for discharging the pile is set to a linear speed v1 (Step S13), and the process control proceeds to Step S8. If the number of the stapled sheets P is less than N (No at Step S6), a linear speed of the discharging motor 35 for discharging the pile is set to a linear speed v3 (Step S14), and the process control proceeds to Step S8.

If the number of the stapled sheets P is less than N (No at Step S8), the discharging motor 35 operates at the linear speed for discharging the pile (Step S15). The discharging claw 38*a* then receives the pile from the movable fence unit 42 that is moving (Step S16). The discharging claw 38*a* then discharges the pile (Step S12).

Therefore, in the embodiment, an operation mode of discharging the pile is switched based on a condition of the sheets P to be discharged, so that both the reliability and the productivity can be improved.

The load applied to the discharging claw 38*a* during the operation of discharging the sheets P depends on the number of sheets P, and the size and the thickness of the sheet P. Therefore, preferably, every time the sheet post-processing apparatus A receives the sheets P from the image forming apparatus B, the sheet post-processing apparatus A detects or receives information on the sheet P from the image forming apparatus B. In this manner, the discharge of the sheets P is controlled as appropriate.

In the embodiment, as described above, the operation of discharging the pile is variably controlled depending on conditions of the sheets P. Thus, it is possible to improve the reliability and the productivity of the sheet post-processing. Furthermore, the linear speed of the discharging motor 35 for discharging the pile is variable depending on conditions of the sheets P. Thus, it is possible to further improve the reliability and the productivity of the sheet post-processing.

Moreover, an image forming (processing) apparatus and an image forming (processing) system to which the sheet post-processing apparatus A is applied can provide improved reliability and the productivity of the sheet post-processing.

According to an aspect of the present invention, it is possible to shorten a time required for discharging the pile of the sheets, and to improve the productivity and the reliability.

Furthermore, it is possible to prevent step-out of the discharging motor. Thus, the reliability can be improved.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet post-processing apparatus comprising:

a sheet stacking unit that receives a plurality of sheets from an upstream apparatus and stacks the sheets in a pile thereon;

an aligning unit that aligns the sheets stacked on the sheet stacking unit in a direction orthogonal to a conveying direction of the sheets;

a moving member that moves up the pile of the sheets aligned by the aligning unit;

a discharging member that receives the pile from the moving member and scoops up the pile by supporting a bottom edge of the pile for discharging the pile out of the sheet stacking unit; and a discharging motor that drives the discharging member in an operation pattern that is selected, depending on a predetermined condition, from among a plurality of operation patterns in which the discharging motor can drive, wherein, if a first operation pattern is selected, a driving linear speed of the discharging motor is at a second level when the discharging member receives the pile from the moving member, and the driving linear speed is increased to a first level that is higher than the second level after the discharging member receives the pile from the moving member, so that the discharging member discharges the pile with the driving linear speed at the first level.

2. The sheet post-processing apparatus according to claim 1, wherein, if a second operation pattern is selected, before the discharging member receives the pile from the moving member, a driving linear speed of the discharging motor is increased to a first level for discharging the pile, so that the discharging member receives the pile and discharges the received pile with the driving linear speed at the first level.

3. The sheet post-processing apparatus according to claim 1, wherein a driving linear speed of the discharging motor for discharging the pile depends on the predetermined condition.

4. The sheet post-processing apparatus according to claim 3, wherein a driving linear speed of the discharging motor for discharging a small-sized sheet is faster than a driving linear speed of the discharging motor for discharging a large-sized sheet.

5. The sheet post-processing apparatus according to claim 1, wherein the predetermined condition is at least one of number of sheets contained in the pile and a size of the sheets.

6. The sheet post-processing apparatus according to claim 3, wherein a driving linear speed of the discharging motor for discharging less than predetermined number of large-sized sheets is faster than a driving linear speed of the discharging motor for discharging equal to or more than the predetermined number of large-sized sheets.

7. The sheet post-processing apparatus according to claim 5, wherein a driving linear speed of the discharging motor for discharging less than predetermined number of large-sized sheets is faster than a driving linear speed of the discharging motor for discharging equal to or more than the predetermined number of large-sized sheets.

8. The sheet post-processing apparatus according to claim 1, wherein the predetermined condition is number of sheets contained in the pile, the discharging motor drives the discharging member in a second operation pattern for discharging less than predetermined number of sheets, in which before the discharging member receives the pile from the moving member, a driving linear speed of the discharging motor is increased to a first level for discharging the pile, so that the discharging member receives the pile and discharges the received pile with the driving linear speed at the first level, and the discharging motor drives the discharging member in the first operation pattern for discharging equal to or more than the predetermined number of sheets.

9. An image forming apparatus that transfers an image onto a recording medium and discharges the recording medium after fixing the image thereon to a sheet post-processing apparatus, wherein the sheet post-processing apparatus is attached to the image forming apparatus and includes a sheet stacking unit that receives a plurality of sheets from an upstream apparatus and stacks the sheets in a pile thereon;

an aligning unit that aligns the sheets stacked on the sheet stacking unit in a direction orthogonal to a conveying direction of the sheets;

a moving member that moves up the pile of the sheets aligned by the aligning unit;

a discharging member that receives the pile from the moving member and scoops up the pile by supporting a bottom edge of the pile for discharging the pile out of the sheet stacking unit; and a discharging motor that drives the discharging member in an operation pattern that is selected, depending on a predetermined condition, from among a plurality of operation patterns in which the discharging motor can drive, wherein, if a first operation pattern is selected, a driving linear speed of the discharging motor is at a second level when the discharging member receives the pile from the moving member, and the driving linear speed is increased to a first level that is higher than the second level after the discharging member receives the pile from the moving member, so that the discharging member discharges the pile with the driving linear speed at the first level.

10. An image forming system comprising:

a sheet post-processing apparatus that includes a sheet stacking unit that receives a plurality of sheets from an upstream apparatus and stacks the sheets in a pile thereon;

an aligning unit that aligns the sheets stacked on the sheet stacking unit in a direction orthogonal to a conveying direction of the sheets;

a moving member that moves up the pile of the sheets aligned by the aligning unit;

a discharging member that receives the pile from the moving member and scoops up the pile by supporting a bottom edge of the pile for discharging the pile out of the sheet stacking unit; and a discharging motor that drives the discharging member in an operation pattern that is selected, depending on a predetermined condition, from among a plurality of operation patterns in which the discharging motor can drive; and an image forming apparatus that transfers an image onto a recording medium and discharges the recording medium after fixing the image thereon to the sheet post-processing apparatus, wherein the sheet post-processing apparatus is attached to the image forming apparatus, and if a first operation pattern is selected, a driving linear speed of the discharging motor is at a second level when the discharging member receives the pile from the moving member, and the driving linear speed is increased to a first level that is higher than the second level after the discharging member receives the pile from the moving member, so that the discharging member discharges the pile with the driving linear speed at the first level.

11. A sheet post-processing apparatus comprising:

a sheet stacking unit that receives a plurality of sheets from an upstream apparatus and stacks the sheets in a pile thereon;

an aligning unit that aligns the sheets stacked on the sheet stacking unit in a direction orthogonal to a conveying direction of the sheets;

a moving member that moves up the pile of the sheets aligned by the aligning unit;

a discharging member that receives the pile from the moving member and scoops up the pile by supporting a bottom edge of the pile for discharging the pile out of the sheet stacking unit; and a discharging motor that drives the discharging member in an operation pattern that is selected, depending on a predetermined condition, from among a plurality of operation patterns in which the discharging motor can drive, wherein a driving linear speed of the discharging motor for discharging the pile depends on the predetermined condition, and a driving linear speed of the discharging motor for discharging a small-sized sheet is faster than a driving linear speed of the discharging motor for discharging a large-sized sheet.

* * * * *